US006796238B2

(12) United States Patent
Goldburt et al.

(10) Patent No.: US 6,796,238 B2
(45) Date of Patent: Sep. 28, 2004

(54) PLATE ROLL LOADING AND POSITIONING APPARATUS AND METHOD

(75) Inventors: Mikhail Goldburt, St. Louis, MO (US); Dave Telken, St. Peters, MO (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 10/237,183

(22) Filed: Sep. 9, 2002

(65) Prior Publication Data

US 2004/0045468 A1 Mar. 11, 2004

(51) Int. Cl.[7] ..... B41F 7/02; B41F 13/20

(52) U.S. Cl. ..... 101/479; 101/218; 101/485; 101/480

(58) Field of Search ..... 101/480, 479, 101/216, 218, 486, 465, 185, 184, 182

(56) References Cited

U.S. PATENT DOCUMENTS 2,901,970 A * 9/1959 Knops et al. ..... 101/247
3,254,598 A * 6/1966 Motter ..... 101/216
3,598,050 A * 8/1971 Thompson ..... 101/216
3,789,757 A * 2/1974 Motter et al. ..... 101/153
4,119,031 A * 10/1978 Ottenhues ..... 101/153
4,132,166 A * 1/1979 Bugnone ..... 101/247
4,998,829 A * 3/1991 Greer ..... 384/255
5,117,768 A * 6/1992 Seymour ..... 118/249
5,787,813 A * 8/1998 Reising ..... 101/479
6,412,409 B2 * 7/2002 Weishew ..... 101/216
6,494,138 B1 * 12/2002 Gottling et al. ..... 101/479

* cited by examiner

*Primary Examiner*—Andrew H. Hirshfeld
*Assistant Examiner*—Leo T. Hinze
(74) *Attorney, Agent, or Firm*—Foley & Lardner LLP

(57) ABSTRACT

The invention relates an automated adjusting arm assembly for conveniently and quickly loading printing press cylinders into a printing press such that proper initial ink and impression settings result without operator adjustment. The assembly includes two stationary plates and movable plates connected to the stationary plates by a plurality of wheels. The movable plates in conjunction with a catch or a capture knob assembly thereon are adapted to lower a printing press roll onto an anilox and/or an impression roll in the printing press.

42 Claims, 16 Drawing Sheets

PLATE ROLL LOADING AND POSITIONING APPARATUS AND METHOD

BACKGROUND OF THE INVENTION

1. Field of the Invention

The present invention relates to the field of printing presses. More particularly, the invention relates to a convenient method for quickly loading printing cylinders into a printing press.

2. Description of the Related Art

Previously, to install a printing press cylinder ("plate roll") in a printing press, an operator would align the cylinder bearings with holes in press adjusting arms and simultaneously skewer a shaft through the holes and the cylinder therebetween. After skewering the cylinder, the operator had to adjust the press adjusting arms to achieve desired ink and impression settings. Adjusting the arms was dependent on the size of the cylinder which, in turn, was reflective of the image repeat length.

While close-fit tolerances of the adjusting arms, shaft, and cylinder facilitate stable and quality printing, a first problem arises in that the tolerances also impede loading of the printing plate cylinder. A second problem arises in that although the cylinder may be properly loaded, the conventional method still requires additional user intervention by requiring that the coarse ink and impression settings be adjusted to coordinate with the size and location of the cylinder.

An alternative method for loading and registering the cylinder involves clamping the two ends of the cylinder in cam followers; the actual contact of the cam followers occurring against wheels on the printing press assembly. However, although the cam followers help minimize the first of the two problems, the second problem still remains, i.e., user intervention is still required to register the ink and impression settings.

Thus, although a number of methods exist for positioning printing press cylinder rolls in the printing nip of a printing press, these approaches have proven to be imperfect for the previously detailed reasons. Accordingly, a new apparatus and method are needed which can quickly and effectively lower a printing press cylinder roll into the printing nip.

SUMMARY OF THE INVENTION

The invention herein contains multiple embodiments including an adjustable arm adapted for use in a printing press, a printing press, and a method for loading a printing press roll in a printing press. A first embodiment of the adjustable arm assembly includes a first stationary plate, a first movable plate movably connected to the first stationary plate, and a speed control mechanism. The first movable plate includes one of a catch or a capture knob assembly adapted to engage a first end of a printing press roll. The speed control mechanism is adapted to control the speed by which a printing press cylinder roll is lowered, is connected to the first movable plate, and is adapted to be connected to an inner surface of a printing press.

In a second embodiment of the adjustable arm assembly, the speed control mechanism may be at least one of an air cylinder and a hydraulic cylinder. In addition, the catch may comprises a semicircular rib which, in turn, may be adapted to support a boss projecting from a cylindrical printing press roll. Further, the rib may be connected to a plate. In addition, the catch may also include a bore block adapted to engage an end of a shaft of a printing press roll. In another embodiment, the first movable plate may be connected to the first stationary plate by a plurality of wheels.

Another embodiment of the adjustable arm assembly may include a second stationary plate and a second movable plate movably connected to the second stationary plate by a plurality of wheels. In this embodiment, the second movable plate may include the other of the catch or capture knob assembly, wherein the other of the catch or capture knob assembly is adapted to engage a second end of a printing press roll.

Another adjustable arm assembly embodiment may include a disengagement mechanism connected to the first stationary plate. Further, the disengagement mechanism may include a rotatable block, a wheel mechanism adapted to rotate the rotatable block, and/or a drive mechanism adapted to push the wheel mechanism so as to cause a rotation of the rotatable block. In addition, the drive mechanism may be at least one of an air cylinder and a hydraulic cylinder. Similarly, in this embodiment, the speed control mechanism may be at least one of a second air and a second hydraulic cylinder.

In an embodiment of the adjustable arm assembly having a disengagement mechanism therein, the assembly may additionally include a rod engaged with a first movable plate and adapted to be releasably engaged with a bore in a rotatable block of the disengagement mechanism.

Another embodiment of the adjustable arm assembly may include a disengagement mechanism which is connected to the first stationary plate and which is adapted to inhibit movement of the first movable plate with respect to the first stationary plate.

As previously mentioned, the invention also pertains to a printing press. A first embodiment of the printing press according to the present invention includes a housing having an inner surface, an adjustable arm assembly connected to the inner surface, and at least one roll adapted to be contacted by a printing press roll when the printing press roll is lowered by the adjustable arm assembly into the press. In this embodiment, the adjustable arm assembly includes a first stationary plate, a first movable plate movably connected to the first stationary plate, and a speed control mechanism. Further, the first movable plate includes a catch adapted to engage a first end of the printing press roll. In addition, the speed control mechanism is adapted to control the speed by which the printing press cylinder roll is lowered, is connected to the first movable plate, and is adapted to be connected to an inner surface of a printing press.

In a second another embodiment of the printing press, the first movable plate may be connected to the first stationary plate by a plurality of wheels. In another embodiment of the printing press, the at least one roll may be an anilox roll and/or an impression roll. In another embodiment, the speed control mechanism may be at least one of an air cylinder and a hydraulic cylinder. In yet another embodiment, the catch may include a semicircular rib. Further, the semicircular rib may be adapted to support a boss projecting from a cylindrical printing press roll. In addition, the rib may be connected to a plate and the catch may also include a bore block adapted to engage an end of a shaft of a printing press roll.

Another embodiment of the printing press may include a second stationary plate and a second movable plate movably connected to the second stationary plate by a plurality of wheels. Further, the second movable plate may include a capture knob assembly adapted to engage a second end of a printing press roll. In yet another embodiment of the printing press, a disengagement mechanism may be provided which is connected to the first stationary plate. Further, the disengagement mechanism may include a rotatable block, a wheel mechanism which is adapted to rotate the rotatable block, and a drive mechanism adapted to push the wheel mechanism so as to cause a rotation of the rotatable block. In addition, the drive mechanism may be at least one of an air cylinder and a hydraulic cylinder. Similarly, the speed control mechanism may be at least one of a second air and a second hydraulic cylinder.

Another embodiment of the printing press may include a rod which is engaged with the first movable plate and which is adapted to be releasably engaged with a bore in a rotatable block. In addition, another embodiment of the adjustable arm assembly may include a disengagement mechanism which is connected to the first stationary plate and which is adapted to inhibit movement of the first movable plate with respect to the first stationary plate.

A method for loading a printing press cylinder roll in a printing press is also contemplated by the current invention. This method includes: (a) positioning a right end of a printing press cylinder roll in a right adjustment arm assembly; (b) positioning a left end of the printing press cylinder roll in a left adjustment arm assembly; (c) actuating a plate roll capturing knob assembly to lock the printing press cylinder roll with respect to the adjustment arm assemblies; and (d) lowering the printing press cylinder roll and the left and right adjustment arm assemblies from an insertion position to a loaded position in which the printing press cylinder roll contacts at least one roll in the printing press.

The aforementioned method may additionally include (e) limiting the speed by which the printing press cylinder roll is lowered. Further, the step of limiting the speed by which the printing press cylinder roll is lowered may be performed by an air or hydraulic cylinder.

Additionally or alternatively, the method may include (e) (or (f)) fine-tuning the orientation of the printing press cylinder roll with respect to the at least one roll in the printing press. Further, the step of fine-tuning the orientation of the printing press cylinder roll with respect to the at least one roll in the printing press may include turning a rod engaged with a disengagement mechanism and a movable plate of one of the adjustable arm assemblies.

The method may also include: (e) engaging a disengagement mechanism when the printing press cylinder roll contacts the at least one roll in the printing press; and (f) fine-tuning the orientation of the printing press cylinder roll with respect to the at least one roll in the printing press. In addition, the disengagement mechanism may include a threaded rod. Further, the disengagement mechanism may also include a rotatable block, a wheel mechanism which is adapted to rotate the rotatable block adapted to engage the threaded rod, and a drive mechanism adapted to push the wheel mechanism so as to cause a rotation of the rotatable block.

Another embodiment of the method, the step of actuating a plate roll capturing knob assembly to lock the printing press cylinder roll with respect to the adjustment arm assemblies comprises: (i) turning a capture knob on the right adjustable arm assembly to force a plunger into the right end of the printing press cylinder roll; and (ii) forcing a left end of the printing press cylinder roll to engage a catch formed in the left adjustable arm assembly.

Another embodiment of the method may include, before the steps of positioning the right end of a printing press cylinder roll in the right adjustment arm assembly and positioning the left end of the printing press cylinder roll in the left adjustment arm assembly, the step of: raising automatically the right and left adjustment arm assemblies to a cylinder roll loading position. Further, the step of automatically raising the right and left adjustment arm assemblies may involve actuating the left and right adjustable arm assemblies simultaneously.

The method may also include: (e) replacing the printing press cylinder roll with a second printing press cylinder roll. Further, the step of replacing the printing press cylinder roll may be automated. In addition, the method could also additionally include: (f) adjusting the second printing press cylinder roll with respect to the at least one roll in the printing press.

An embodiment of the method may also include: (e) establishing automatically a predetermined clearance between the printing press cylinder roll and the at least one roll of the printing press. Further, the step of establishing automatically a predetermined clearance between the printing press cylinder roll and the at least one roll of the printing press may include: (i) engaging a disengagement mechanism to lock the right and left adjustment arm assemblies in the loaded position; and (ii) activating an adjustment arm raising mechanism to push the right and left adjustment arms assemblies towards the insertion position to attain the predetermined clearance. In addition, the predetermined clearance is between about 0.00001" and about 0.01".

Another embodiment of the method may include: (e) establishing automatically a predetermined clearance between the printing press cylinder roll and the at least one roll of the printing press; and (f) fine-tuning the orientation of the printing press cylinder roll with respect to the at least one roll in the printing press. Further, the step of fine-tuning the orientation of the printing press cylinder roll with respect to the at least one roll in the printing press may include: turning a rod engaged with a disengagement mechanism and a movable plate of one of the adjustable arm assemblies.

Finally, in any of the previous method embodiments, the at least one roll in the printing press may be an anilox roll and/or an impression roll.

These and other features, aspects, and advantages of the present invention will become more apparent from the following description, appended claims, and accompanying exemplary embodiments shown in the drawings.

BRIEF DESCRIPTION OF THE DRAWINGS

The accompanying drawings, which are incorporated in and constitute a part of the specification, illustrate an embodiment of the invention and together with the description, serve to explain the principles of the invention.

DETAILED DESCRIPTION

Figure 1:
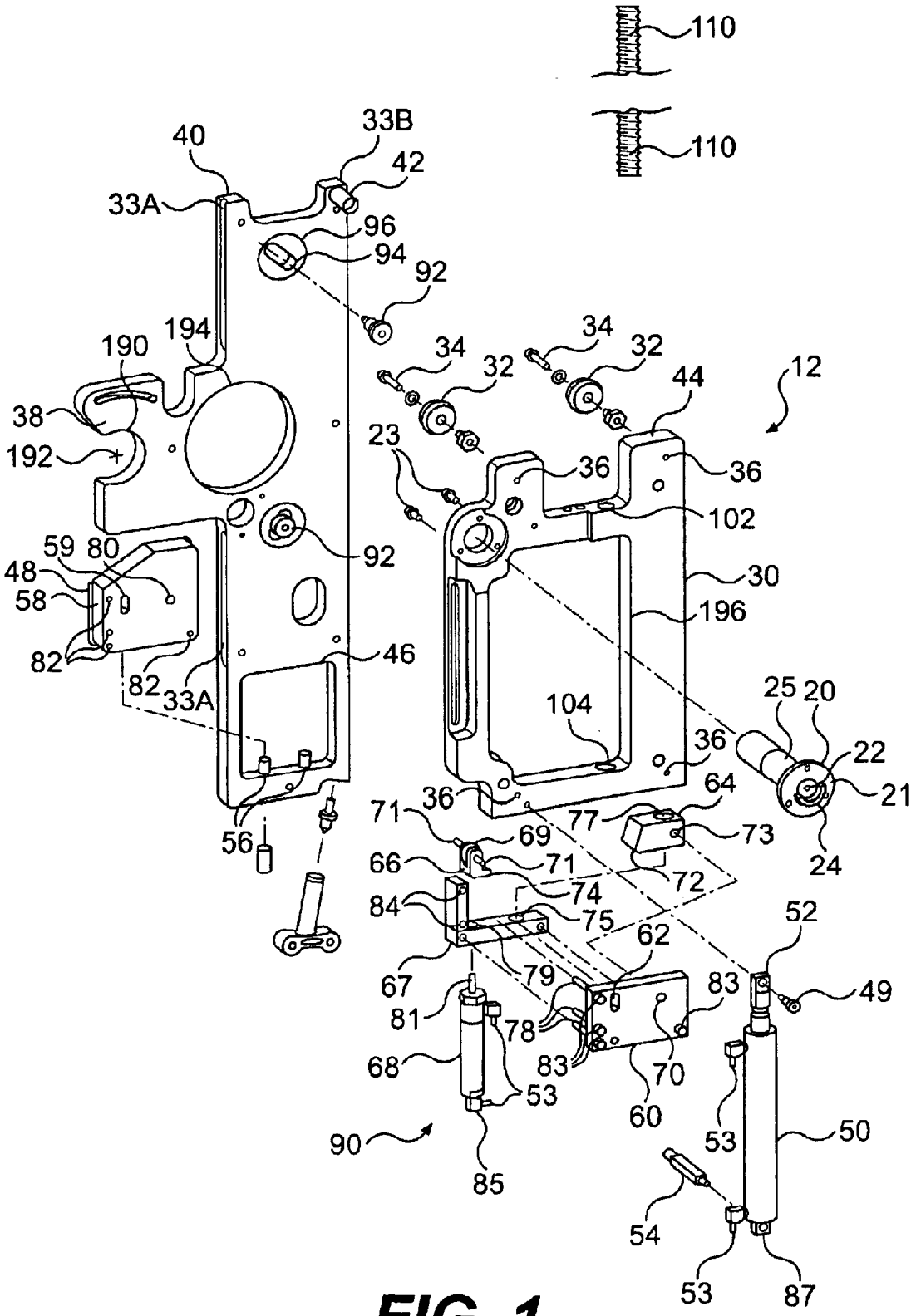
FIG. 1 is an exploded view of the various parts used in a left side adjustable arm assembly for automatically loading a printing press cylinder.

Reference will now be made in detail to presently preferred embodiments of the invention, which are illustrated in the drawings. An effort has been made to use the same reference numbers throughout the drawings to refer to the same or like parts.

Figure 2:
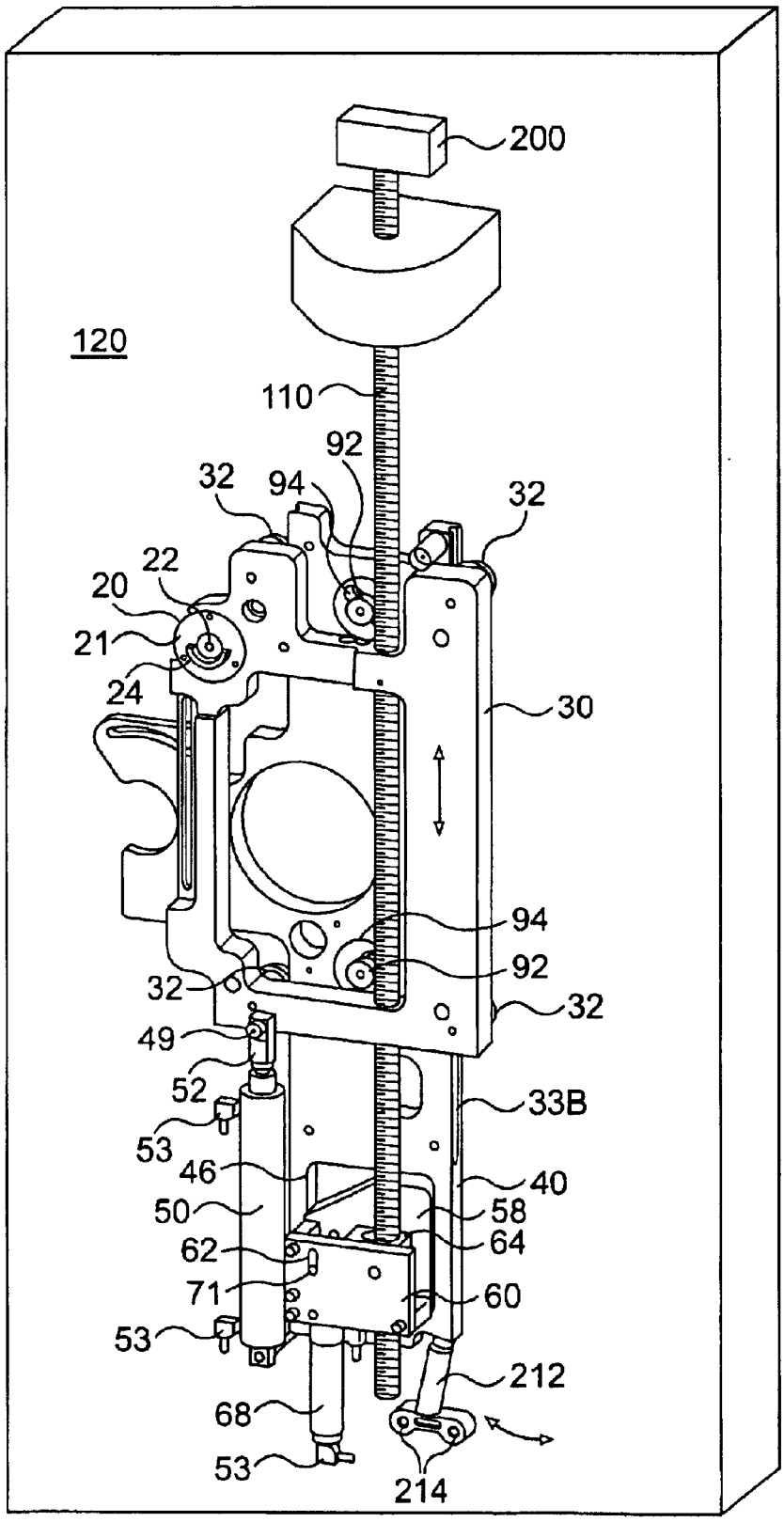
FIG. 2 is a perspective view of a left side adjustable arm assembly having the parts of FIG. 1.
Figure 4:
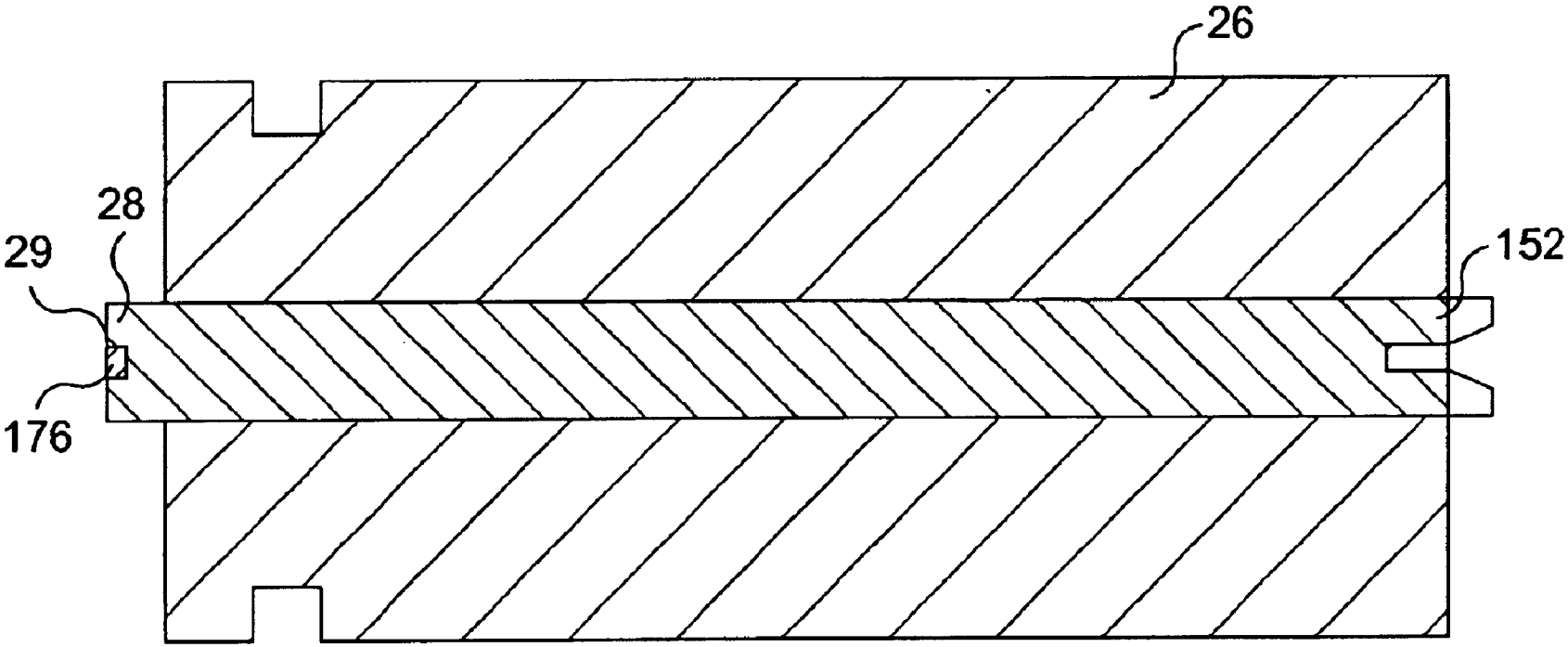
FIG. 4 is a cross-sectional view of a print cylinder.
Figure 12:
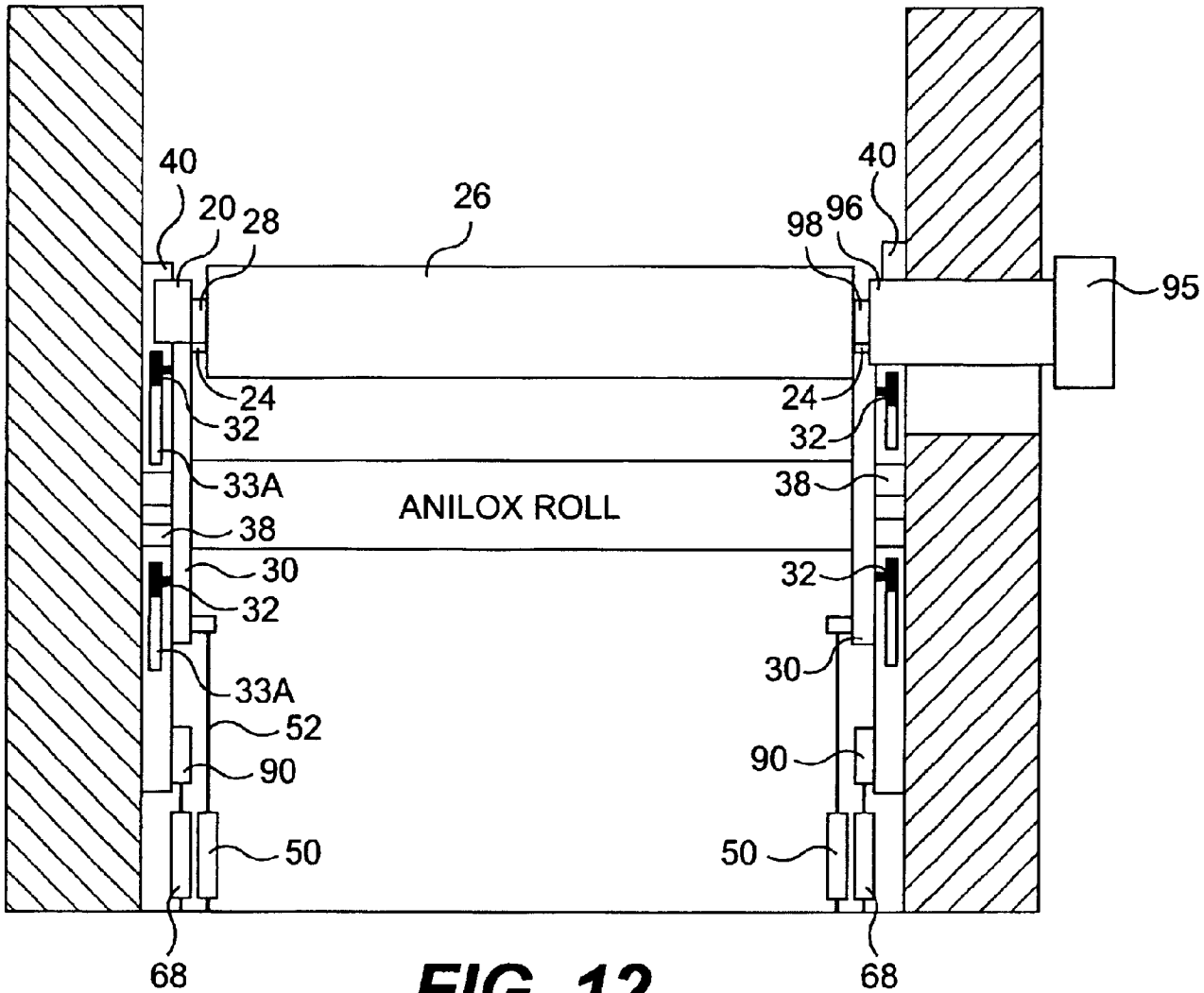
FIG. 12 is a side view of a press cylinder loaded between two adjusting arm assemblies each of which is connected to an inner surface of a printing press, the cylinder being above an anilox roll of a printing press.
Figure 13:
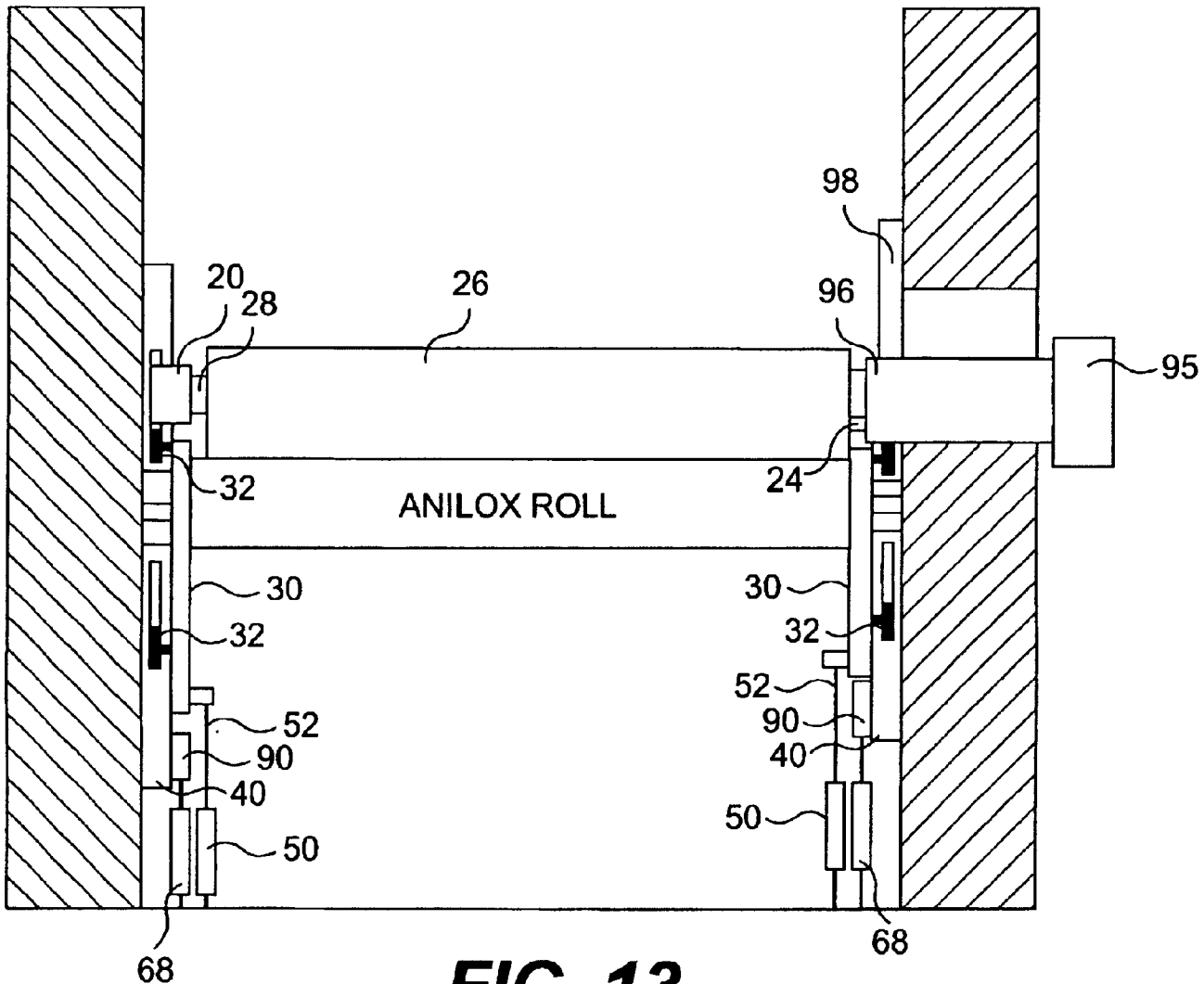
FIG. 13 is a side view of the press cylinder of FIG. 12 having been lowered into a position at which is adjacent the anilox roll of the printing press.

FIG. 1 is an exploded view of the various parts of a left-side adjusting arm assembly 12 according to one embodiment consistent with the present invention. The adjusting arm assembly 12 is for automatically loading a printing press cylinder (also called a "printing press roll" or a "plate roll") 26 shown in FIG. 4. FIG. 2 is a perspective view of the left side assembly 12 of FIG. 1 fully assembled. FIG. 12 is a side view of a press cylinder loaded between two adjusting arm assemblies each of which is connected to an inner surface of a printing press, the cylinder being above an anilox roll of a printing press. FIG. 13 is a side view of the press cylinder of FIG. 12 having been lowered into a position at which is adjacent the anilox roll of the printing press.

The left side assembly 12 includes a roll catch 20, a movable plate 30, a stationary plate 40, an air cylinder 50 (which may, for example, be solenoid actuated), and a disengagement mechanism 90, each of which will be discussed in turn. A right side assembly is the mirror image of the left side assembly 12 except that a capture knob assembly 150/250 (later discussed in detail) replaces the roll catch 20. Further, due to the weight of the press cylinder 26 supported by the adjustable arm assemblies 12, it is preferable that at least the stationary plates 40, the movable plates 30, the catch 20, capture knob assembly 150, and the disengagement mechanisms 90 be formed out of strong materials such as, for example, steel.

Figure 3:
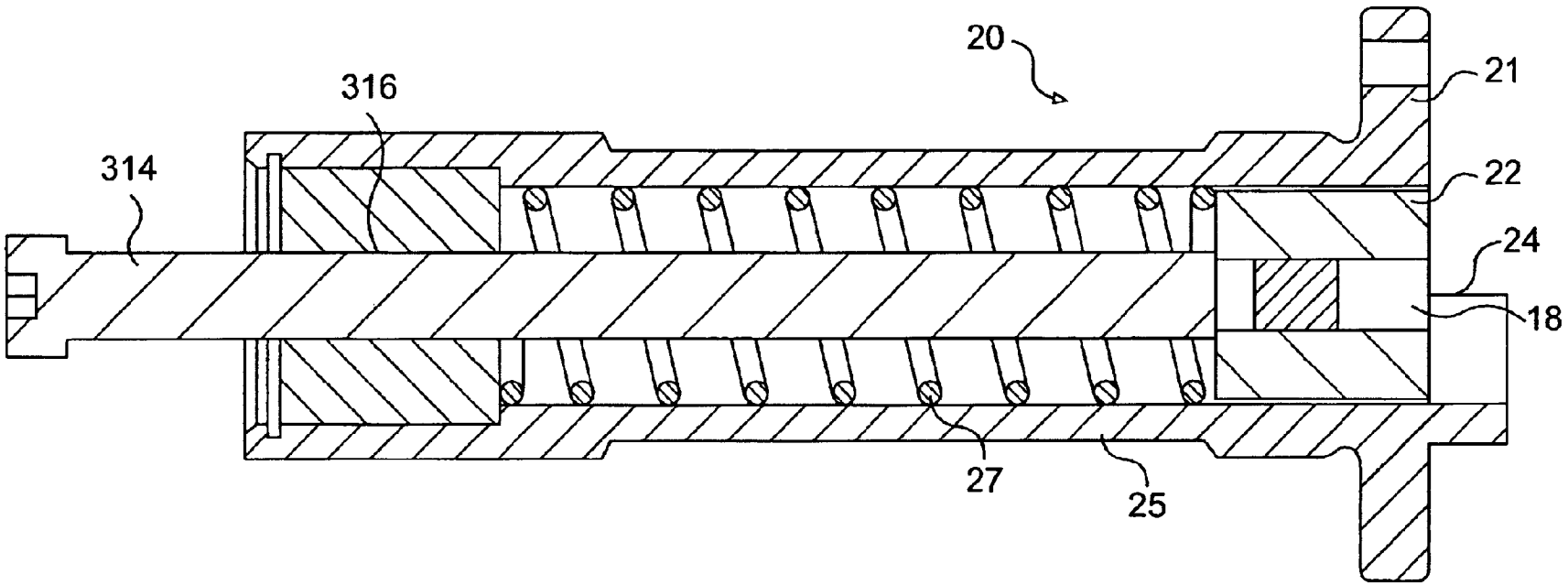
FIG. 3 is a side cross-sectional view of a left catch.

The roll catch 20 depicted in FIG. 1 is positioned on the left side of cylinder roll 26. A side cross-sectional view of the left load catch 20 is provided in FIG. 3. The left side roll catch 20 comprises a plate 21, semicircular rib 24, and a bore block 22 in a central portion of the plate 21. The bore block 22 is adapted to receive an end 29 (shown in FIG. 4) projecting from a shaft 28 of a cylinder roll 26 (i.e., the bore block 22 acts as a female engagement mechanism which receives the end 29 of the shaft 28 which acts as the corresponding male engagement mechanism). It should be noted that an indentation 18 may be provided in the bore block 22 which will be better adapted to engage with cylinder rolls 26 which have pointed ends 29 on the shaft 28 thereof. The plate 21 of the left side catch 20 is connected to the movable plate 30 associated therewith by a plurality of fasteners 23.

Preferably (and for reasons later described in detail), on the right side of the cylinder roll 26 (which engages the capture knob assembly 150/250), the orientation of the male/female engagement is reversed, i.e., the female member is on the cylinder roll 26 in the form of a plunger hole 152 adapted to receive a tip 154 of a plunger 98/298 projecting from the capture knob assembly 150/250.

To load a cylinder roll 26 into the left side catch 20, the end 29 projecting from the left end of the shaft 28 is positioned against the bore block 22 in the plate 21 of the left side catch 20; the shaft 28 is positioned such that it rests on the semicircular rib 24. The left side catch 20, which acts as a spring-loaded bushing, also comprises a hollow tube 25 in which a spring 27 is compressible. When the bore block 22 receives the end 29 of the cylinder shaft 28 and pressure is applied thereto, the bore block 22 is pushed into the tube 25 thereby compressing the spring 27. Further, easy sliding of the bore block 22 is ensured by its distal end 314 being journalled through a bore 316.

Figure 5:
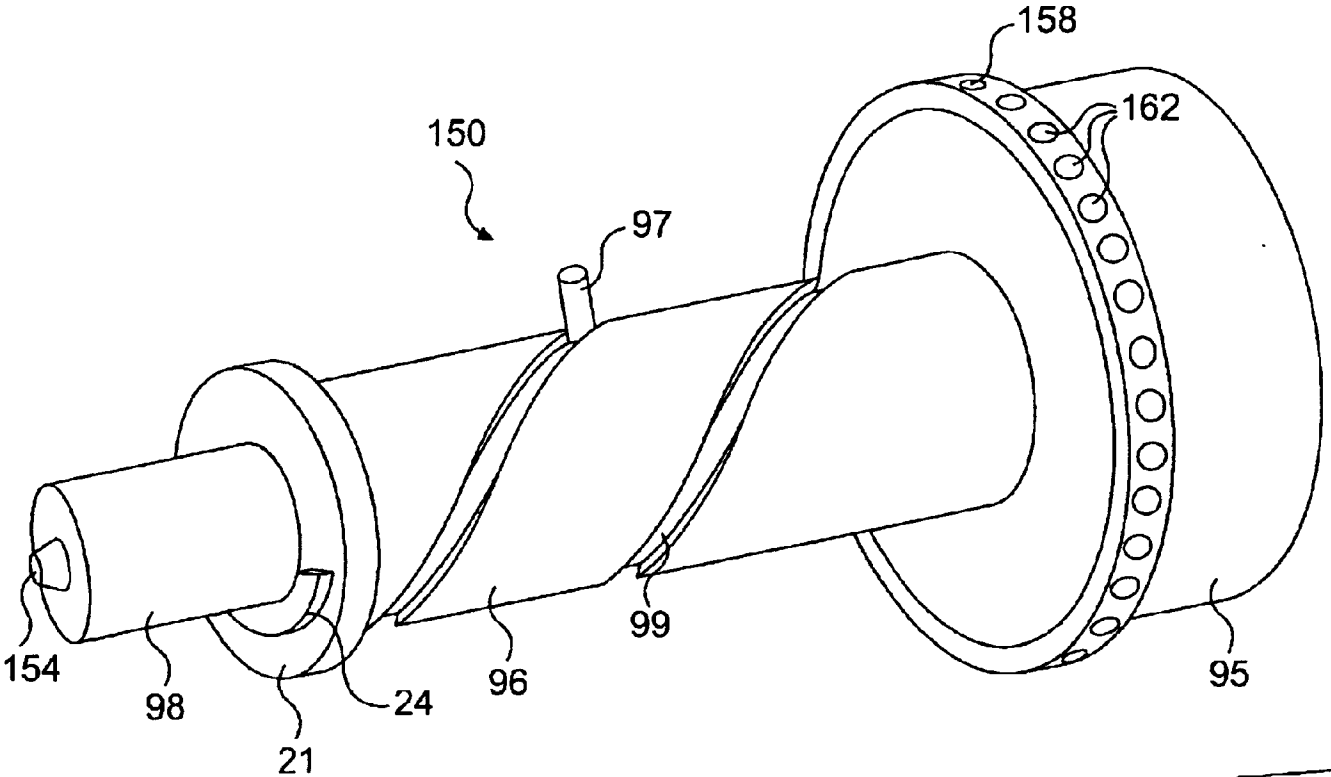
FIG. 5 is a perspective view of a capture knob assembly having a helical slit in a tube portion thereof.

Having explained the left side catch 20, an understanding of the capture knob assembly 150/250 is necessary to understand how the right side of the cylinder roll 26 is fixed in a printing press. A first embodiment of a capture knob assembly 150, which is shown in FIGS. 5–8, includes a capture knob 95 which is connected to a hollow tube 96 having a helical slot 99 formed therein. As shown in FIG. 5, a front portion of the hollow tube has a plate 21 thereon which supports a semicircular rib 24 both of which are similar to the plate 21 and the rib 24 on the left side catch 20.

Figure 7A:
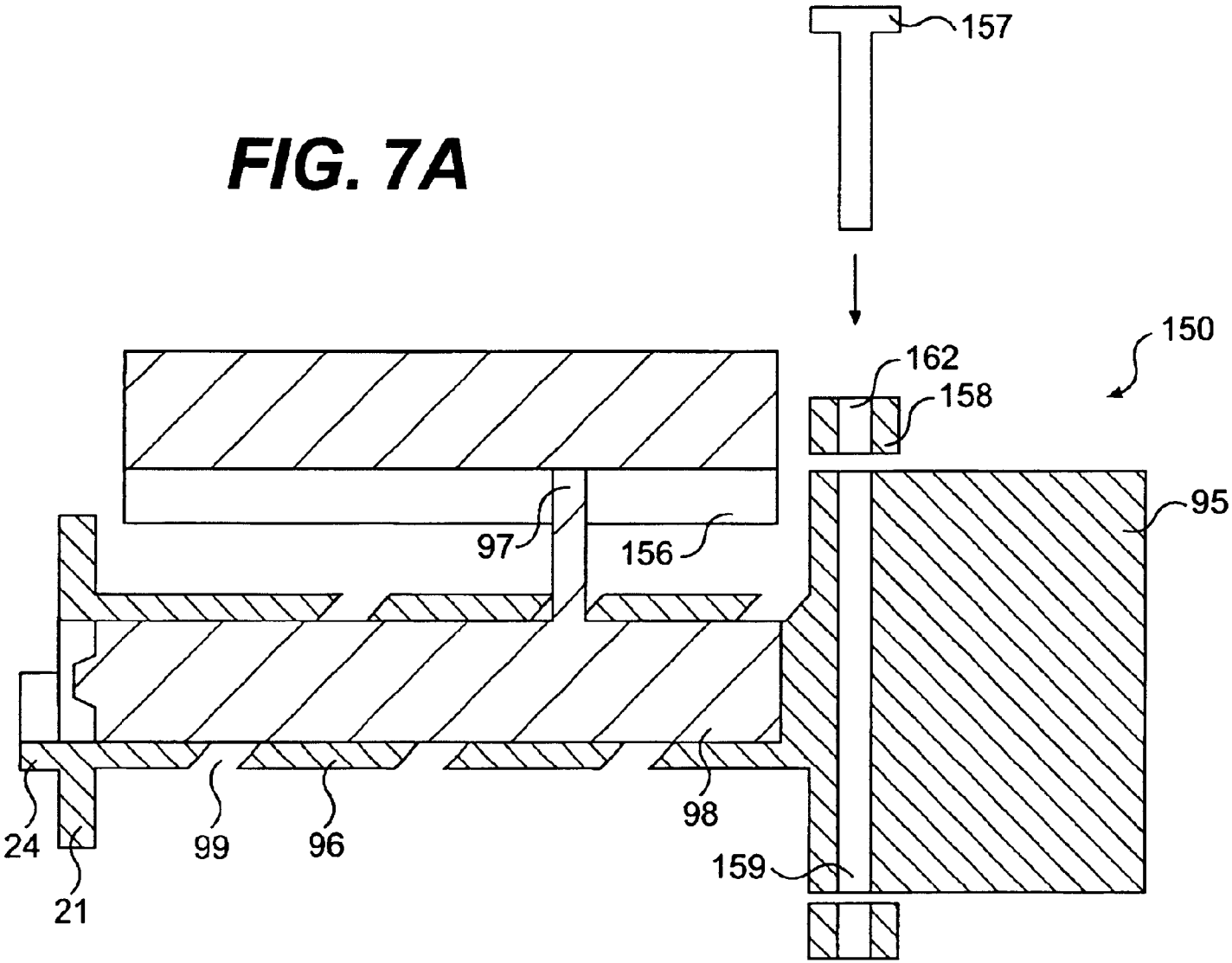
FIG. 7A is a side cross-sectional view of the capture knob assembly of FIG. 5 showing the plunger of FIG. 6, which slides in and out of the tube portion of the capture knob assembly, in a first position.
Figure 7B:
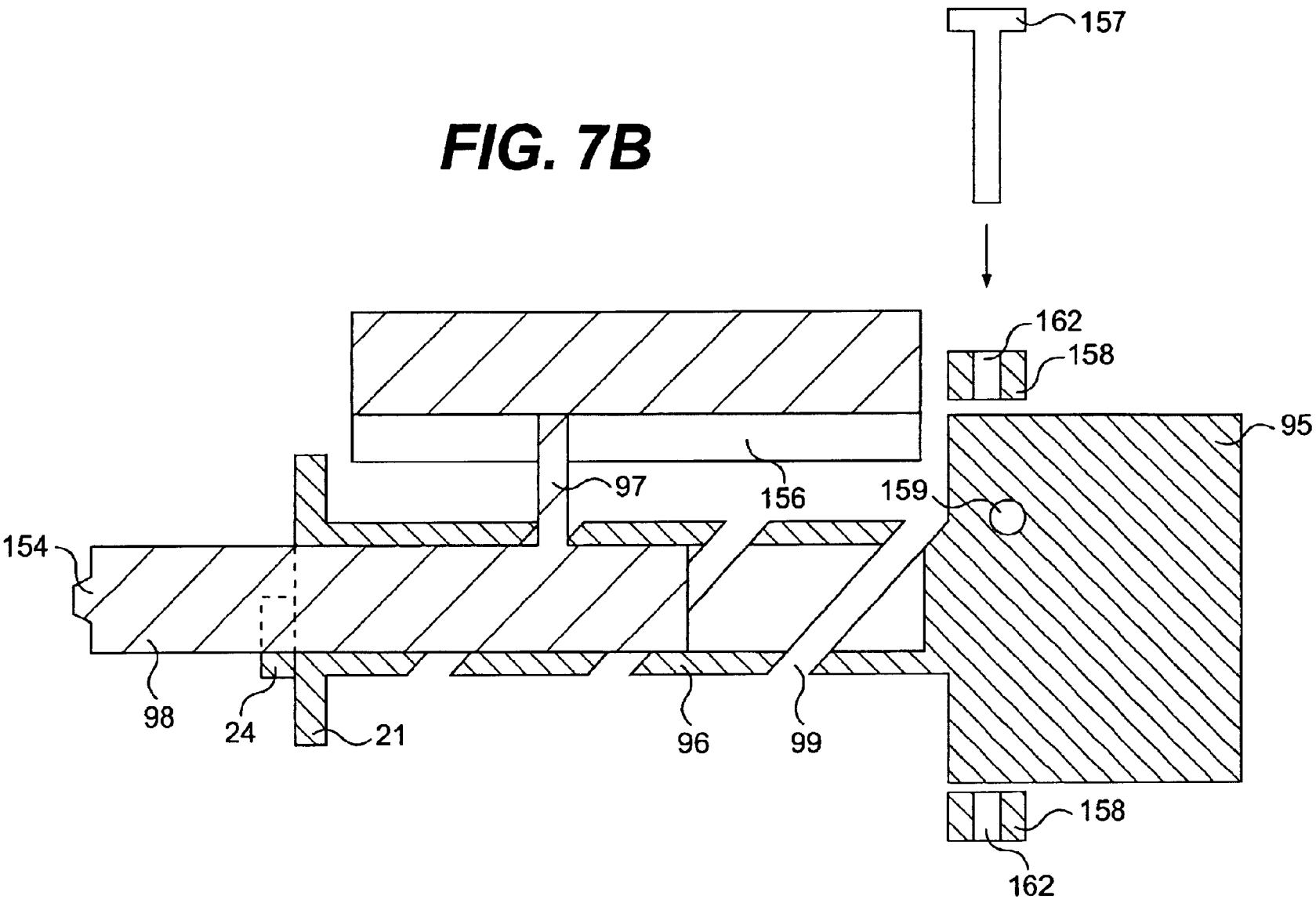
FIG. 7B is a side cross-sectional view of the capture knob assembly of FIG. 7A showing the plunger in a second position, the cross-section being taken along the same plane of the capture knob assembly as the cross-section of FIG. 7A.

A projection 97 extends out of the helical slot 99 and slides within a linear slot 156 formed above the tube 96 in a wall of the press, as shown in FIGS. 7A and 7B; the linear slot 156 runs parallel to the tube 96. When the capture knob 95 is turned, the projection 97 is moved, by the helical slot 99, linearly along the linear slot 156.

Figure 6:
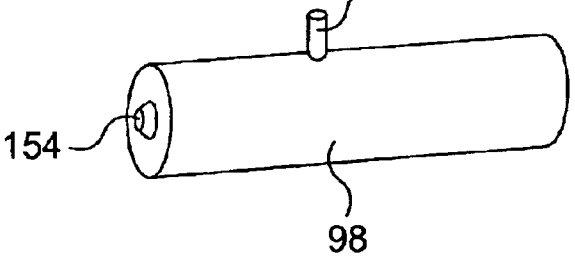
FIG. 6 is a perspective view of a plunger housed within the capture knob assembly of FIG. 5.

The projection 97, which may be in the form of a steel rod or ball, is connected to a plunger 98 (as shown in FIG. 6) which is journalled within the hollow tube 96. Accordingly, when the capture knob 95 is turned clockwise (and the projection 97 moves linearly along the tube 96 away from the capture knob 95), an end of plunger 98 away from the capture knob 95 will move from a first position (FIG. 7A) in which the plunger 98 is substantially housed within the hollow tube 96 to a second position (FIG. 7B) in which the plunger 98 protrudes, from the end of the hollow tube 96.

A tip 154 of the plunger 98 is adapted to slide into the hole 152 in the right end of the cylinder roll 26 thereby engaging the plunger 98 to the roll 26. A further turning of the capture knob 95 will push the left end 29 of the cylinder shaft 28 against the bore block 22 shown in FIG. 3 (thereby compressing the spring 27 in the left catch). As a result of the pressure applied to both ends of the cylinder roll 26, the cylinder roll 26 will be fixedly held by the left catch 20 and by the capture assembly 150.

Preferably, the pressure applied to the capture knob assembly 150 is adjustable. After applying the desired pressure to cylinder roll 26 by means of the capture assembly 150, the rotation of the capture knob 95 can be locked in any conventional manner. For example, a collar 158 can be provided around a base of the knob 95. If the collar 158 has a plurality of holes 162 provided at periodic locations around the collar 158, and if the knob 95 has a bore (or hole) 159 therein (or therethrough), when the knob 95 is sufficiently turned, a rod 157 can be journalled through a hole 162 in the collar 158 and then into (or through) the bore/hole 159 in the knob 95 (and possibly through a second hole 162 in the collar 158 on the opposite side of the collar 158 as the first hole 162). When the rotation of the capture knob 95 is locked, the cylinder roll 26 is locked in place between the left catch 20 and the capture rod assembly 150.

Figure 8:
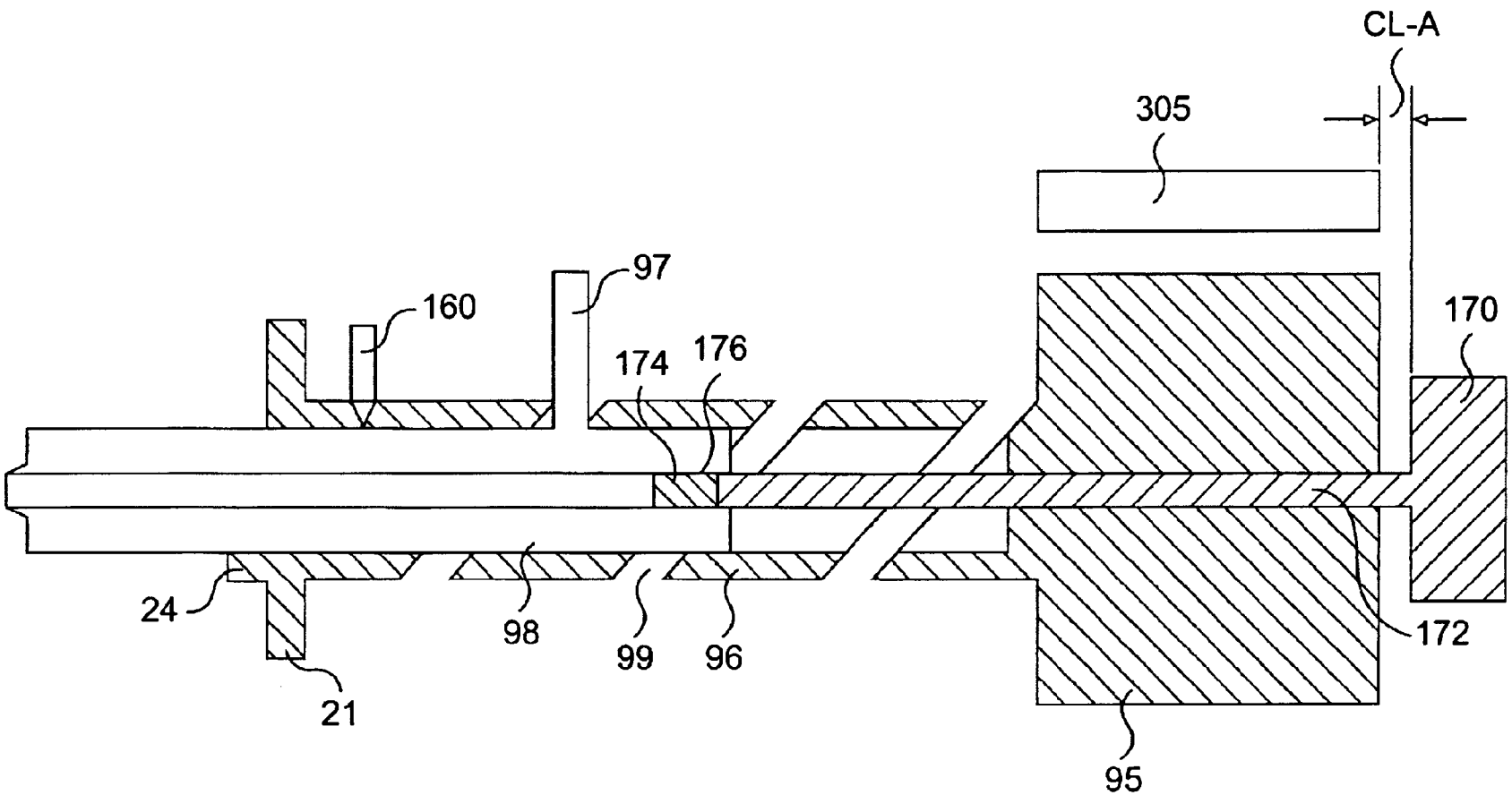
FIG. 8 is a side view of the capture knob assembly including a position sensor and a lateral adjustment knob.

The capture rod assembly may also comprise a position sensor 160 and/or a lateral adjustment knob 170, both of which are shown in FIG. 8. The position sensor 160 may be used to determine when the plunger 98 is sufficiently extended from the capture rod assembly 150 to engage the right end of the cylinder roll 26 while preventing damage to either the cylinder roll 26 or the plunger 98 which might result if the plunger 98 is pushed with too great a pressure against the right end of the cylinder roll 26.

The lateral adjustment knob 170 would be used in cases where the capture knob assembly 150 applies a fixed pressure to the cylinder roll 26 to lock it between the left catch 20 and the plunger 98 (i.e., where a collar 158 or other adjustable locking mechanism is not employed). The lateral adjustment knob 170 shown in FIG. 8 is fixed with respect to a body 305 of the press (i.e., the clearance CL-A between the lateral adjustment knob 170 and the body 305 does not change when the lateral adjustment knob 170 is turned). The lateral adjustment rod 170 is connected to a rod 172 having a threaded portion 174 on the far end thereof. The rod 172 can be positioned to run through a bore in the capture knob 95 and into a hole the plunger 98.

The threaded portion 174 of the rod 172 can be connected to a correspondingly threaded portion 176 of the plunger 98. When the threaded portion 174 is engaged to the plunger 98, the lateral adjustment knob 170 can be used to pull (or push) the capture knob assembly 150 thereby increasing or decreasing the pressure on the cylinder roll 26. Of course, it should be readily appreciated that a threaded engagement is merely exemplary of the type of engagement which can established between the rod 172 and the plunger 98. Further, although it is preferable to connect the lateral adjustment knob 170 to the plunger 98, the lateral adjustment knob 170 could be engaged to the capture knob 95 to provide similar advantages.

Figure 14:
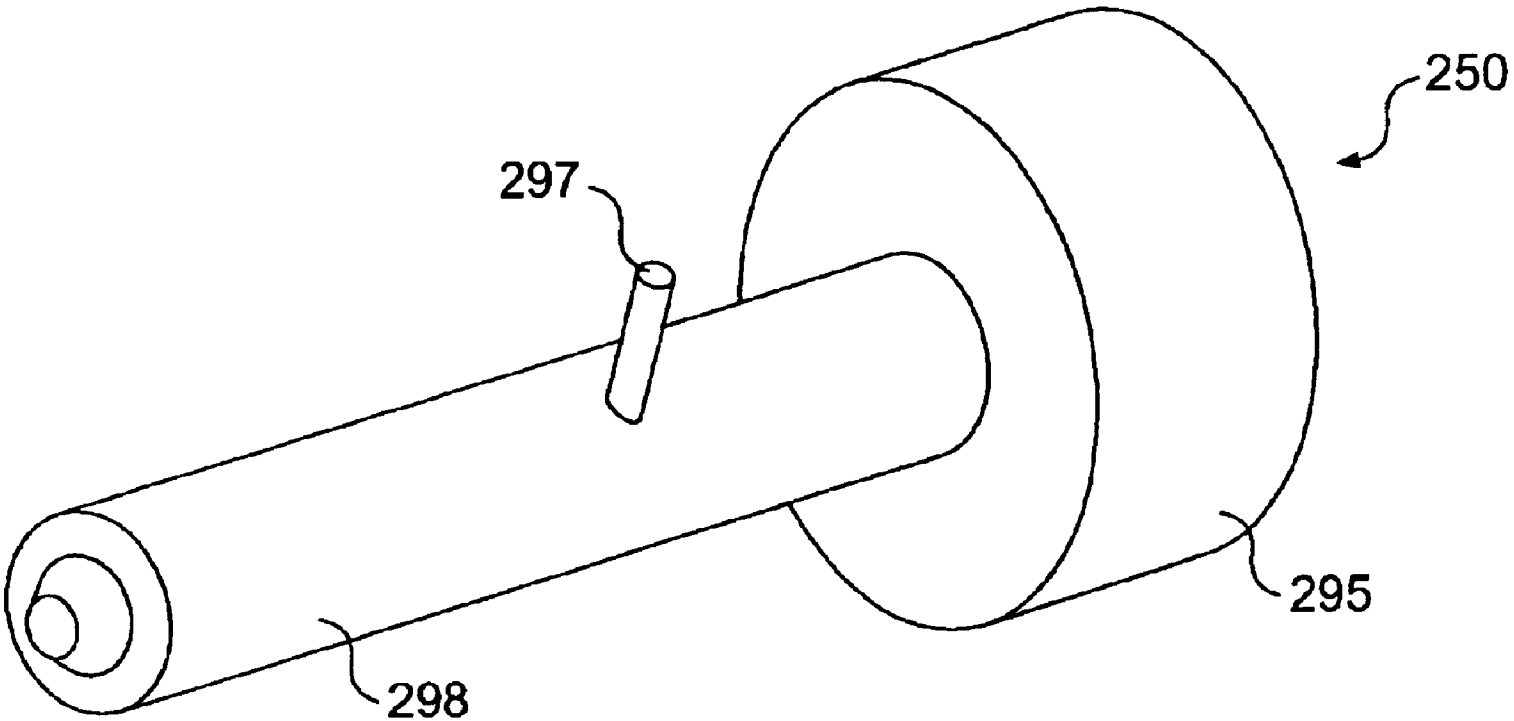
FIG. 14 is a perspective view of a second embodiment of a capture knob assembly.
Figure 15A:
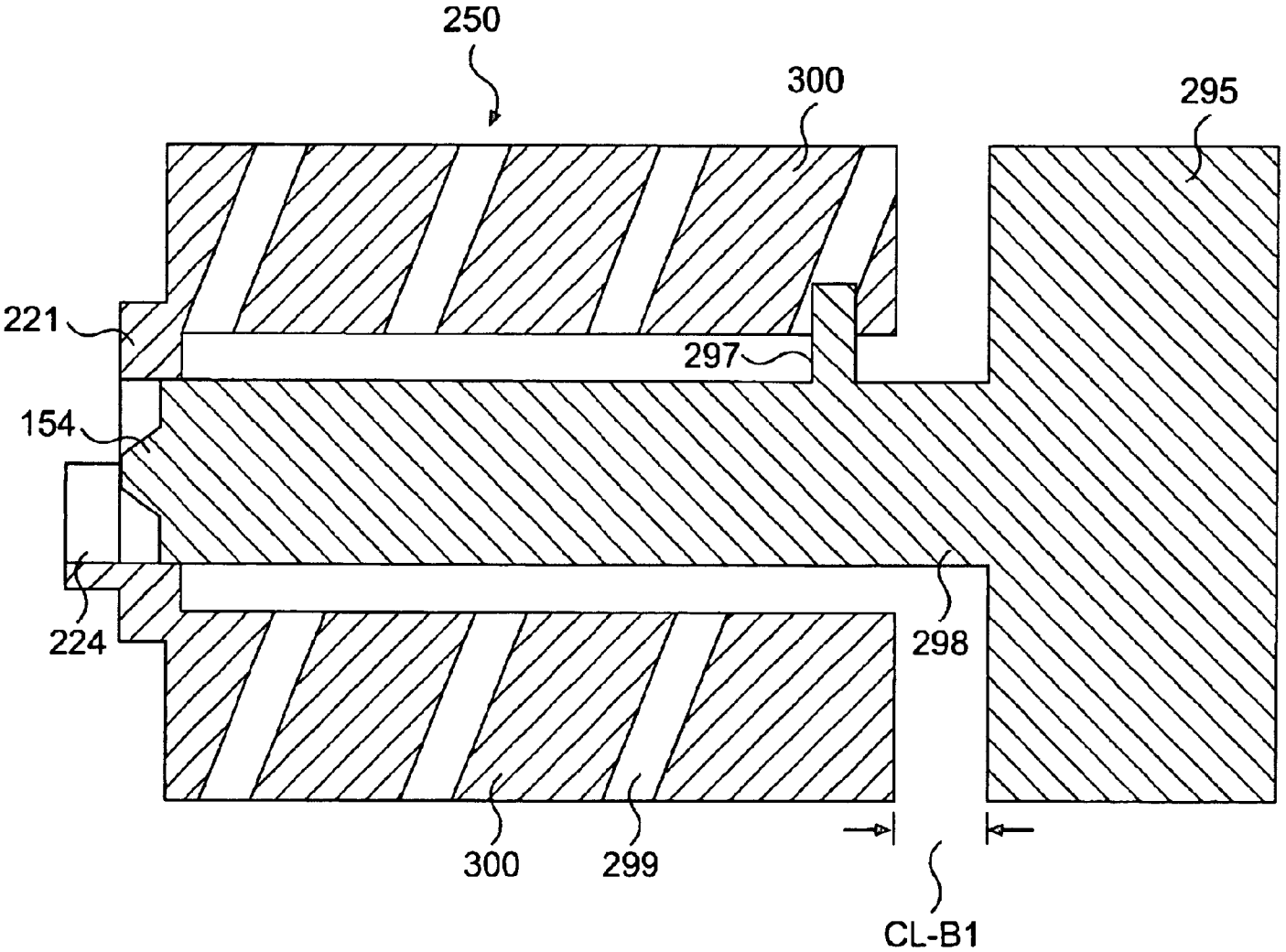
FIG. 15A is a side cross-sectional view of the capture knob assembly of FIG. 14 showing a plunger and a capture knob in a first position.
Figure 15B:
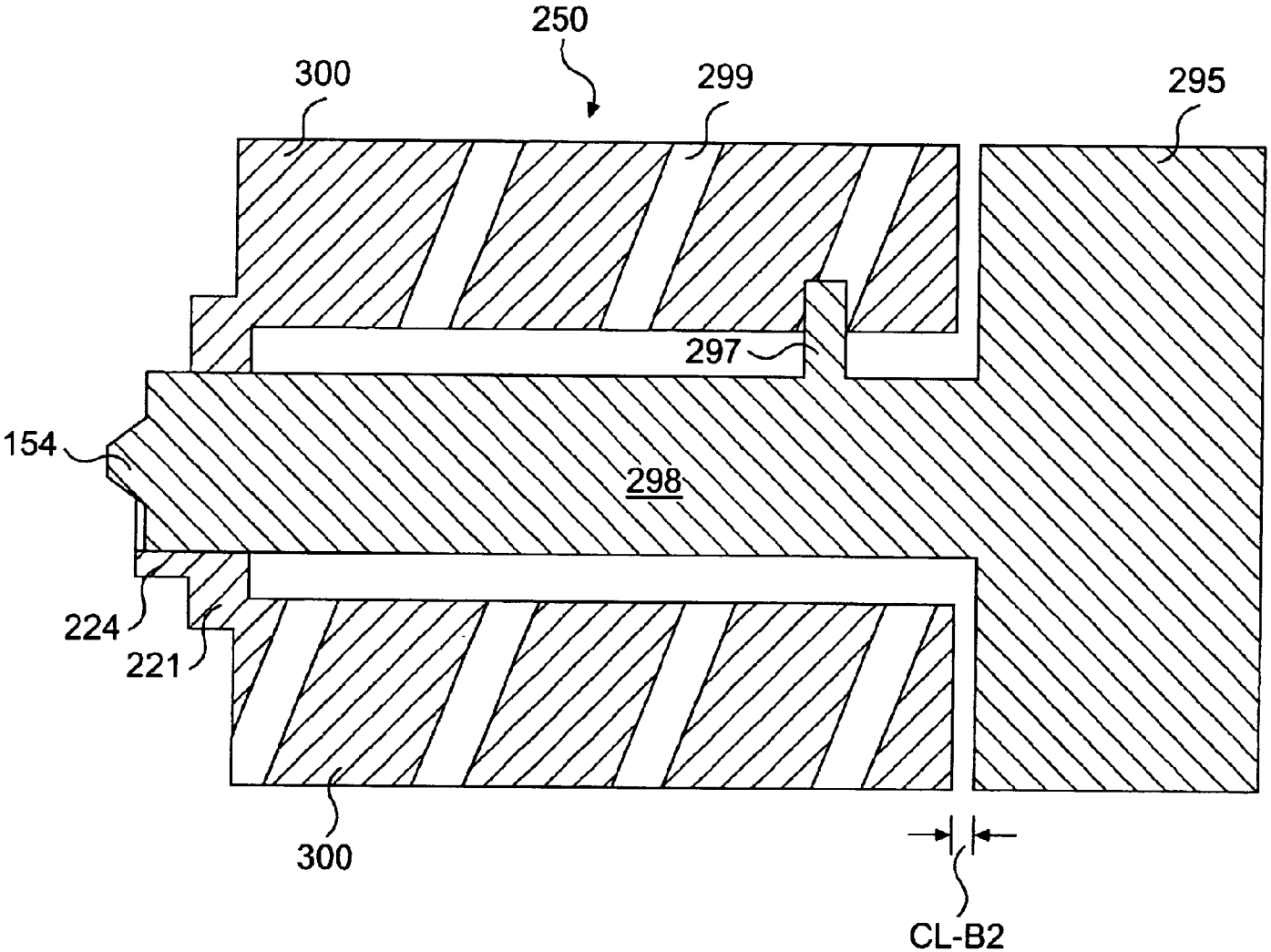
FIG. 15B is a side cross-sectional view of the capture knob assembly of FIG. 15A showing the plunger and capture knob in a second position, the cross-section being taken along a different plane of the block (in which the capture knob assembly is housed) than the cross-section of FIG. 15A.

A second embodiment of the a capture knob assembly 250 is provided in FIGS. 14 and 15. FIG. 14 is a perspective view of the second embodiment of the capture knob assembly 250. FIG. 15A is a side cross-sectional view of the capture knob assembly 250 showing a plunger 298 and a capture knob 295 in a first position and FIG. 15B is a side cross-sectional view of the capture knob assembly of FIG. 15A showing the plunger 298 and capture knob 295 in a second position.

Unlike the previously described capture knob assembly 150, in this embodiment, as shown in FIG. 14, the plunger 298 is integral with the capture knob 295. Although the plunger 298 has a projection 297 extending therefrom which is similar to the previously described projection 97, unlike the previous embodiment, this projection 297 will rotate when the capture knob 295 is rotated. As a result, the projection 297 will travel laterally in a helical channel 299 formed in a block 300 surrounding the plunger 298. However, as the capture knob 295 is integral with the plunger 298, the knob 295 will move from an unengaged position (FIG. 15A) to an engaged position (FIG. 15B) thereby reducing a clearance between the capture knob 295 and the block 300; the clearance will change from a first clearance CL-B1 to a narrower second clearance CL-B2. Further, it should be understood that cross-section of FIG. 15B is taken along a different plane of the block 300 (in which the capture knob assembly 250 is housed) than the cross-section of FIG. 15A so that the projection 297 remains visible in the figure.

Additional improvements could be made to the second embodiment of the capture knob assembly 250. For example, the capture knob assembly could be provided with a position sensor 160 and/or a lateral adjustment knob 170 of the type previously described with respect to the first embodiment capture knob assembly 150.

Referring to FIG. 1, each of the movable plates 30 has a plurality of wheels 32 (i.e., v-roller bearings) connected thereto. The wheels 32 are positioned on the side of the plates 30 on the side which is adjacent the cylinder 26 between the movable plates 30. Further, the wheels 32 are mounted such that they freely rotate along axes which are substantially perpendicular to the movable plates 30. Although only two wheels 32 are visible in FIG. 1, it is to be understood that more wheels may be used. Preferably, each plate 30 will have four wheels 32, one positioned in the vicinity of each corner of the generally rectangular plate (as shown in FIG. 2). Regardless of the numbers of wheels 32 employed, each wheel 32 attached to a movable plate 30 should be positioned such that the outer circumference thereof will rest within a channel 33 formed in the stationary plate 40 associated with the movable plate 30.

As shown in FIGS. 1 and 2, the left side stationary plate 40 has two channels 33 positioned therein. The first channel 33A is separated into two section whereas the other channel 33B may run the length of the stationary plate 40. To connect the movable plate 30 to the stationary plate 40, the following steps are taken; (a) the movable plate 30 is laid upon the stationary plate 40; (b) the wheels 32 are inserted into the channels 33 in the stationary plate such that the wheels' axes are aligned with fastener holes 36 in the movable plate 30; and (c) fasteners 34 are journalled through the wheels 32 and into the fastener holes 36 in the movable plate 30. As a result of the wheels 32 on both sides of the stationary plate 40, the movable plate 30 is movably connected to the stationary plate 40.

Each movable plate 30 is prevented from rolling off of the stationary plate 40 associated therewith by a projection 38 on the stationary plate 40. The projection 38 projects between wheels 32 on one side the movable plate 30 (i.e., the projection 38 divides the first channel 33 into its respective parts 33A) As a result, the movable plate 30 can not be completely disengaged from the stationary plate 40.

When a cylinder 26 is loaded in the left roll catch 20 and right capture knob assembly 150/250 (as shown in FIG. 12), the cylinder 26 will fall under its own weight until its outer surface contacts the printing press anilox roll (as shown in FIG. 13) and/or the impression roll. The speed by which the cylinder falls is limited by a speed control mechanism in the form of an air cylinder 50, one end of which is connected to the movable plate 30 by a fastener 49 and the other end of which is connected to an inner surface of the printing press. Specifically, when the cylinder 26 is to be placed into the left catch 20 and into the capture knob assembly 150/250, a rod 52 of the air cylinders 50 (connected to each movable plate 30) will be fully extended from the air cylinder 50.

It should be noted that, as the assembly 12 shown in FIGS. 1 and 2 is not installed in a printing press, the rod 52 is shown as being substantially housed within the air cylinder 50 when the movable plate 30 is in the upper position (i.e., the position in which print cylinders 26 are exchanged). In actualilty, however, when the movable plate 30 is in this position, the rod 52 would be extended and a lower end 87 of the air cylinder 50 would be connected to the printing press by means of the pin 54.

When the print cylinder 26 is loaded, the rods 52 of each assembly 12 will be pulled (by means of compressed air pressure) back into the air cylinders 50 associated therewith, thereby causing air in the air cylinders 50 to be exhausted through one or more vents 53 therein at a substantially fixed rate. The fixed rate exhaustion of the air in the air cylinders 50 inhibits the print cylinder 26 from accelerating when falling toward the anilox roll and/or the impression roll, i.e., the print cylinder 26 falls at a substantially fixed rate. In addition, a speed governor (not shown), such as a oil filled dashpot damper, may be used as an alternative to, or in conjunction with, the air cylinder 50 to fix an upper limit on the speed at which the print cylinder 26 falls toward the anilox roll. When the print cylinder 26 has reached the anilox roll, the rods 52 will be substantially housed within the air cylinders 50 and the disengagement mechanisms 90 will be activated.

Figure 10:
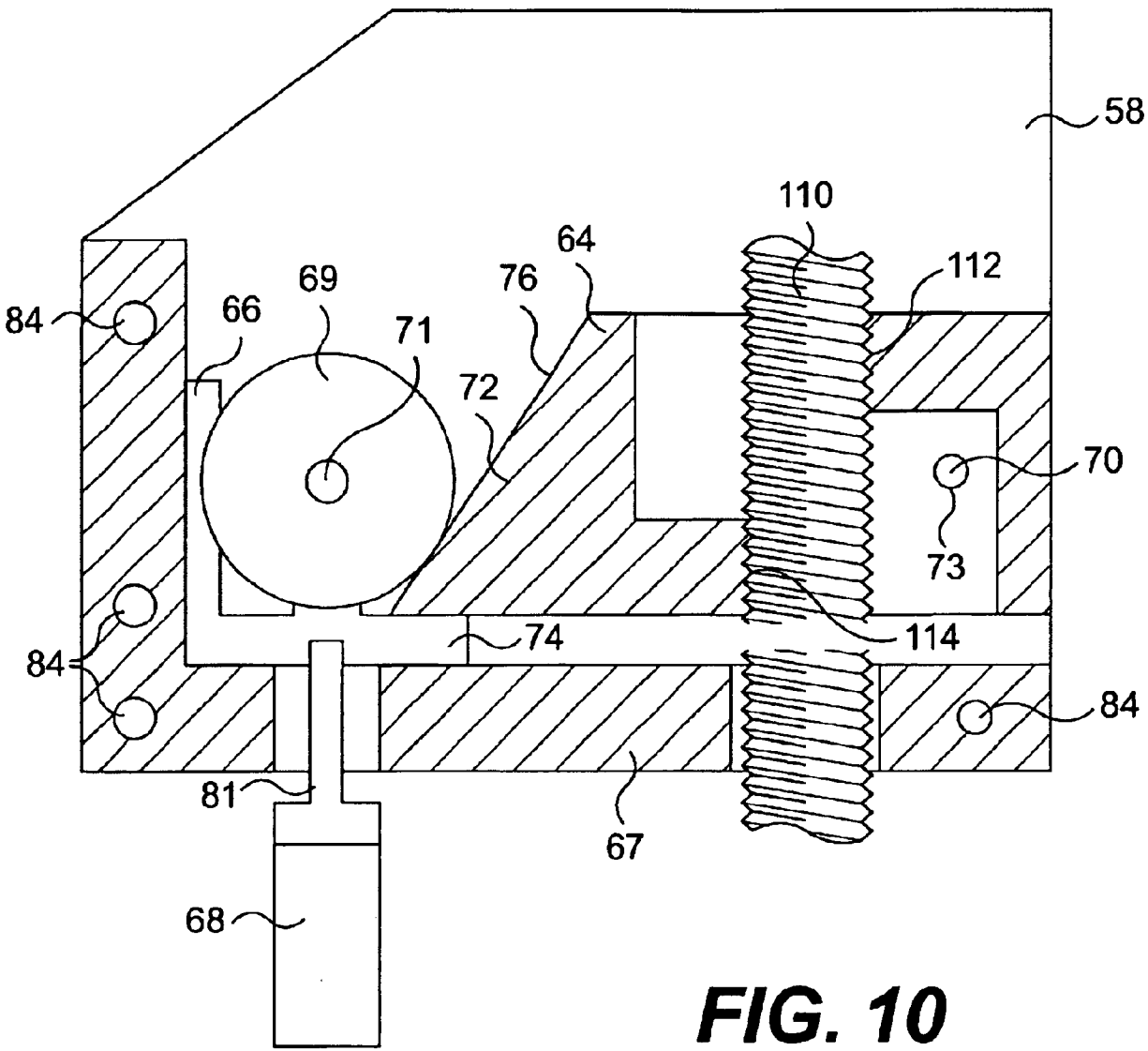
FIG. 10 is a side cross-sectional view of a disengagement mechanism showing a rotatable block thereof in an engaged position.
Figure 11:
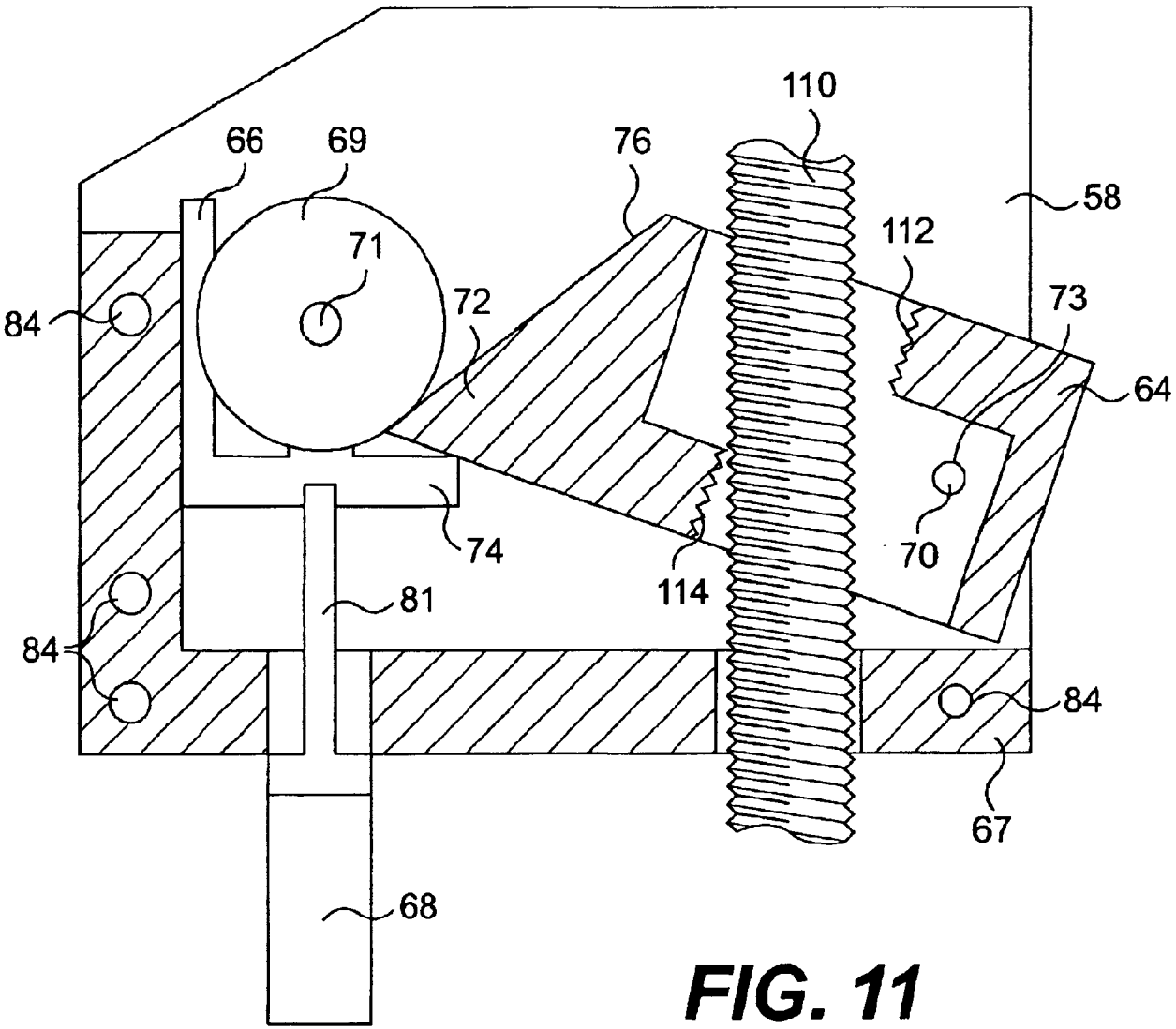
FIG. 11 is a side cross-section view of the disengagement mechanism of FIG. 10 showing the rotatable block in a disengaged position.

As shown in FIGS. 1, 10, and 11, the disengagement mechanism 90 comprises a connection plate 58, an L-shaped plate 67 (which may be formed by two separated pieces of steel to reduce manufacturing costs), a cover plate 60, a rotatable block 64, a wheel mechanism 66, and a drive mechanism which is preferably a solenoid actuated air cylinder 68. The connection plate 58 includes a plurality of screw holes 82 which are adapted to be aligned with bores 84 in the L-shaped plate 67 and further aligned with bores 83 in the cover plate 60. Similarly, the connection plate 58 includes a screw hole 80 which is adapted to be aligned with a bore 73 in the rotatable block 64 and further aligned with a bore 70 in the cover plate 60. In addition, the connection plate 58 comprises bores (not shown) in an underside thereof which are sized to receive springs 56 projecting from the stationary plate 40, as later described in detail. Finally, the connection plate 58 includes a vertical slot 59 sized to receive a pin 71 of the wheel mechanism 66; the pin 71 extends through the wheel 69 and serves as an axle.

The connection plate 58 is connected to the stationary plate 40 by being inserted into a window 46 (shown in FIG. 1) in the stationary plate 40 and pushed downward such that the springs 56 of the stationary plate 40 are received in the bores (not shown) in the underside of the connection plate 58. The connection plate is inserted from the side of the stationary plate 40 opposite the movable plate 30. The connection plate 58 is prevented from passing through the widow 46 by means of a lip 48 on an outer edge of the connection plate 58 which is adapted to sit in a milled-out groove (not shown) in the back side of the stationary plate 40 when the connection plate 58 is inserted in the window 46. Further, the connection plate 58 will be prevented from falling backward out of the window 46 because a threaded rod 110 (later discussed in detail) on the other side of the window 46 is engaged with the rotatable block 64 which, in turn, is connected to the connection plate 58.

After the connection plate 58 is connected to the stationary plate 40, the L-shaped plate 67 can be positioned against the connection plate 58 such that the bores 84 in the L-shaped plate are aligned with the holes 82 in the connection plate 58. At this time, the wheel member 66 can be positioned such that a pin 71 projecting along the axis of the wheel 69 is inserted into the vertical slot 59 in the connection plate 58. In addition, the rotatable block 64 can be positioned so that the bore 73 therethrough is aligned with the hole 80 in the connection plate 58. When the bore in the rotatable block 64 is aligned with the hole 80 in the connection plate 58, a front portion 72 of the rotatable block 64 is adapted to rest on a ledge 74 on the wheel member 66 such that an angled front face 76 may abut the wheel 69 of the wheel member 66, as shown in FIG. 10.

After the L-shaped member 67, the wheel member 66, and the rotatable block 64 are properly aligned with connection plate 58, the cover plate 60 can be positioned such that: (a) the bores 83 therein are aligned with the bores 84 in the L-shaped plate 67 and with the screw holes 82 in the connection plate 58; (b) the bore 70 therein is aligned with the bore 73 in the rotatable block 73 and the screw hole 80 in the connection plate 58; and (c) a second pin 71 on the wheel member 66 is inserted into a vertical slot 62 in the cover plate 60. Finally, fasteners 78 (e.g., screws) can be pushed through the bores 83 in the cover plate 60 and the bores 84 in the L-shaped plate 67 and screwed into the screw holes 82 in the connection plate 58. Due to the plurality of fasteners 78 connecting the cover plate 60, the L-shaped plate 67, and the connection plate 58, the cover plate 60, L-shaped plate 67, and connection plate 58 will be unable to move with respect to each other.

By way of contrast, although the wheel member 66 will be "locked" between the cover plate 60 and the connection plate 58 (by means of the pins 71 projecting therefrom which are received in the vertical slots 62, 59 in the cover plate 60 and the connection plate 58), the wheel member 66 will be able to slide vertically to the extent permitted by the vertical slots 62, 59. Further, after a fastener 70 is pushed through the bore 73 in the cover plate 60, through the bore 73 in the rotatable block 64, and screwed into the hole 80 in the connection plate 58, the rotatable block 64 will be able to rotate around the fastener 70 therethrough.

After the cover plate 60, L-shaped plate 67, wheel member 66, rotatable block 64, and the connection plate 58 are connected, a top end of a spring-loaded telescoping arm 81 of the air cylinder 68 can be journalled through a bore 79 in the L-shaped plate 67 and connected to the wheel member 66. A lower end 85 of the air cylinder 68, like the lower end 87 of the other air cylinder 50 will be connected to the printing press.

After the disengagement mechanism 90 is assembled, a threaded rod 110 is screwed through screw holes 102, 104 in the movable plate 30. It is also possible to connect the rod 110 and the movable plate 30 in other equally feasible ways such as, for example, employing snap rings such that the cross-section of the rod 110 in the holes 102, 104 is smaller than the cross section of the rod 110 above and below each of the holes 102, 104. The important factor is that the position of the rod 110 be substantially fixed with respect to the movable plate 30.

After screwing the threaded rod 110 through the screw holes 102, 104 it is screwed downward until it encounters the bore 77 in the rotatable block 64. Note that when the wheeled mechanism 66 is in the downward position, such that the rotatable block 64 is substantially parallel to the L-shaped plate 67, the threaded rod 110 will engage corresponding thread portions 112, 114 in the rotatable portion 64, as shown in FIG. 10. The threaded rod 110 is screwed through the block 64 and passes through the bore 75 in the L-shaped plate 67. The upper end of the threaded rod 110 is fixed to the press, as shown in FIG. 2. Although the threaded rod 110 is shown as being threaded along its length, this is not necessary. Rather, the threaded rod need only be designed to engage the rotatable block 64 along the threaded portions 112, 114 and be immobile with respect to the movable plate 30.

After each disengagement mechanism 90 is fully assembled, the assemblies 12 will be connected to a printing press as follows: (a) each stationary plate 40 is positioned in a predetermined position against a wall 120 (shown in FIG. 2) in the printing press such that the movable plate 30 associated therewith is on the side of the stationary plate 40 opposite the printing press wall; (b) fasteners 92 (shown in FIG. 1) are screwed through a curved slot in counterbore 94 in the stationary plate 40 and into screw holes (not shown) in the wall 120 of the printing press behind the stationary plate 40 (later, as will be described in detail, the stationary plate is adapted to rotate along the wall 120 because the fasteners 92 are adapted to ride in the curved slots); (c) the fasteners 92 are screwed until the heads thereof rest within wells 96 in the stationary plate 40; and (d) that lower ends of the air cylinders 50, 68 are affixed to a lower surface of the press, as shown in FIGS. 12 and 13.

Referring to FIG. 1, after each stationary plate 40 (with its respective movable plate 30 affixed thereto) is affixed to the wall 120 of the press, the anilox and impression rolls are connected as follows. The anilox roll slides into a semicircular wedge 190 such that it will rotate around a central point (indicated by crosshairs 192) in the semicircular wedge 190. Similarly, each end of the impression roll is journalled through a rectangular opening 196 in the movable plate 30 and into circular openings 194 in the stationary plate 40. The rectangular opening 196 in the movable plate provides clearance such that when the movable plate is raised and lowered, the impression roll is neither affected nor contacted.

Use of a printing press having the assembly installed therein will now be described in detail. Before a print cylinder 26 is loaded for use in the printing press, the telescoping arm 81 of the air cylinder 68 will be extended thereby pushing the wheel member 66 upward such that the pins 71 projecting therefrom are positioned in the uppermost positions in the vertical slots 62, 59 in the cover plate 60 and the connection plate 58. In this position, as shown in FIG. 11 the threaded portions 112, 114 of the rotatable portion 64 disengage from the threaded rod 110 thereby enabling the threaded rod 110 (with the movable plate 30 affixed thereto) to move vertically upward with respect to the disengagement mechanism 90.

Referring to FIG. 11, when the rotatable block 64 is disengaged from the threaded rod 110, the movable plate is driven upward by air cylinder 50. When the movable plate is at its upper position, the left end of the print cylinder roll 26 is affixed to left side catch 20 and the right end of the cylinder roll 26 is locked using the capture knob assembly 150/250, as previously described. When the cylinder 26 is loaded, it will be lowered by the air cylinders 50 (i.e., the telescoping arms 52 are pulled back into the air cylinders 50 and air is vented therefrom through the vents 53) until its outer surface contacts the anilox roll and/or the impression roll, i.e., until it becomes "nested" with respect to either or both of the anilox and impression rolls as shown in FIG. 13.

At this point, the telescoping arms 81 of each disengagement mechanism 90 are pulled downward into their respect air cylinders 68. When the arms 81 are pulled downward, they correspondingly pull the wheel members 66 downward. In turn, the wheels 69 of the wheel members push downward on the sloped faces 76 of the rotatable blocks 64 thereby causing the blocks to rotate back to the orientation shown in FIG. 10. When the rotatable blocks rotate back toward the horizontal, the threaded portions 112, 114 therein engaged the threaded rod 110 such that the threaded rod is no longer movable with respect to the disengagement mechanism, i.e., it is "locked."

When the threaded rods 110 are locked, the air cylinders 50 will be actuated again in an attempt to push the movable plates 30 upward. However, because the movable plates 30 are fixedly connected to the threaded rods 110, the attempted upward movement of the movable plates 30 will be substantially thwarted. However, although the upward motion of the movable plates 30 is thwarted, the force applied thereto by the telescoping arms 81 of the air cylinders is such that it raises the movable plates on the order of 0.0001" of an inch away from the anilox and/or impression rolls thereby providing clearance which prevents the anilox and/or impression roll from being dented by the cylinder roll 26. This 0.0001" clearance is thus automatically generated whereas in the prior art such clearance needed to be achieved with operator intervention. Further, this clearance may be as great as 0.01" and possibly as great as 0.02".

If desired, fine-turning of the vertical position of the cylinder roll 26 can be accomplished with a knob 200 (shown in FIG. 2) connected to the top of each of the threaded rolls 110 which enables the threaded rod 110 to be turned. The turning of the threaded rods 110 will raise or lower the rods 110 (and the movable plates 30 affixed thereto) by enabling the rods 110 to be screwed with respect to the threaded portions 112, 114 of the rotatable blocks 64 thereof.

Figure 9:
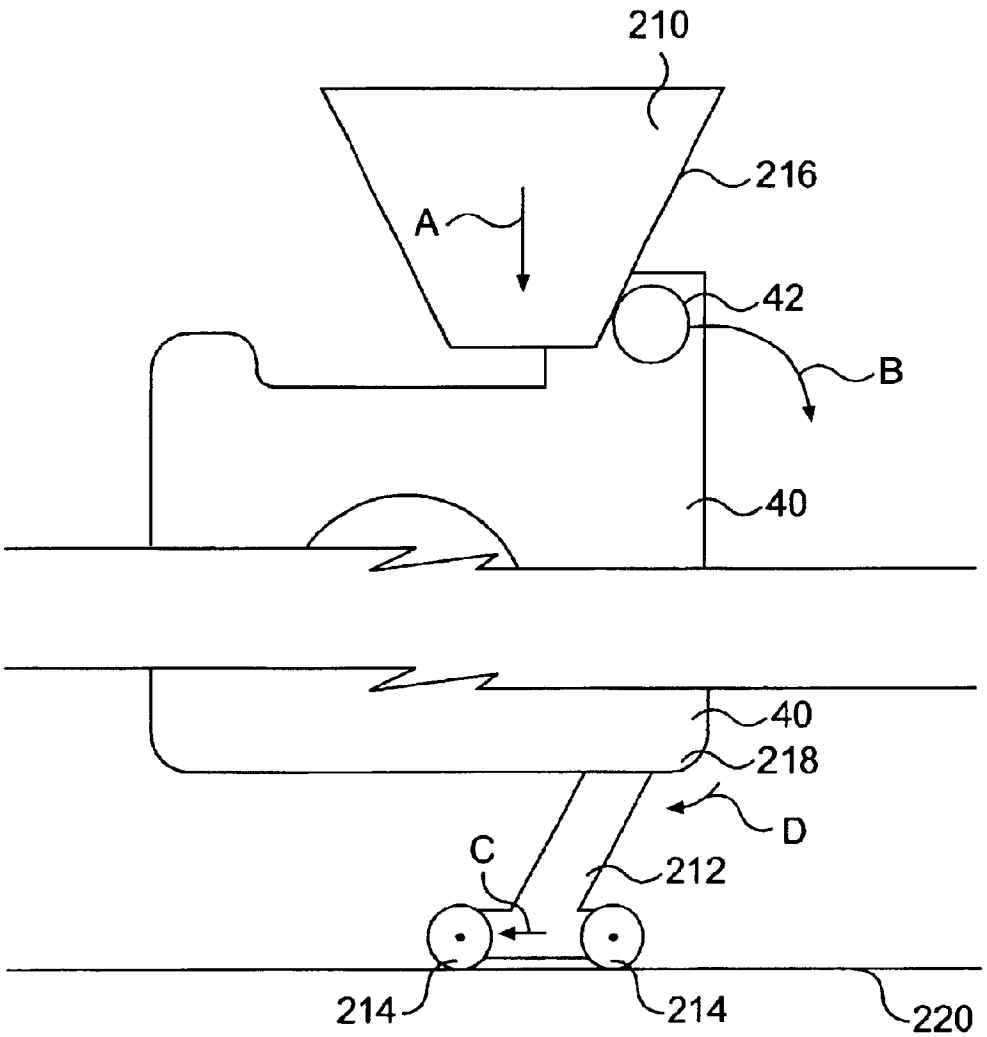
FIG. 9 is a side view of an inverted cone engaging a boss which projects from a stationary plate.

In addition, fine-tuning of horizontal position of the cylinder roll 26 may be accomplished as follows. FIG. 9 shows an inverted cone 210 which may be raised and lowered. When the cone 210 is lowered in the direction of arrow A, an angled face 216 thereof will abut a projection 42 which projects from the side of the stationary plate 40 against which the movable plate 30 is positioned. Due to further downward motion of the inverted cone 210, the projection 42 will be forced to move (along sloped face 216) in the direction of curved arrow B thereby causing a slight rotation of the stationary plate 40. It should be noted that the stationary plate 40 is adapted to rotate because the fasteners 92 affixing it to the inner wall 120 of the printing press are adapted to ride in the curved slots in counterbores 94 formed in the stationary plate 40. It also should be noted that the radius of each of the curved slots of the counterbores 94 have the same central point, i.e., the curved slots are on the circumference of a hypothetical circle. Further, the center of that hypothetical circle is preferably collocated with respect to the center of the anilox roll indicated by crosshairs 192.

As a result of the rotation of the stationary plate 40, the lower corner 218 of the stationary plate 40 will move in the direction of curved arrow D. When the lower corner 218 moves, a compressible member 212 (which may be a spring)

will be slightly compressed and will roll, by means of wheels 214, along a wall 220 of the press in the direction of arrow C.

If the cylinder roll 26 is pushed too far horizontally, the inverted cone 210 can be raised thereby causing the compressible member 212 to expand thereby, in turn, pushing the plate in the direction opposite arrow D (and moving the wheels 214 in the direction opposite to arrow C) such that the projection 42 moves in the direction opposite arrow B. As a result, the cylinder roll 26 will be moved back horizontally as far as necessary.

Although the aforementioned describes preferred embodiments of the invention, the invention is not so restricted. It will be apparent to those skilled in the art that various modifications and variations can be made to the disclosed preferred embodiments of the present invention without departing from the scope or spirit of the invention. For example, rather than allowing the print cylinder 26 to fall into position under its own weight (and having its fall controlled by air cylinder 50), the system could employ a motor to lower (and raise) the cylinder 26 in a controlled manner. In addition, plastics and/or castings may be used instead of steel in manufacturing some of the parts (e.g., the air cylinders 50, 68) of the assembly 12 to reduce the cost of manufacturing the assembly 12 and to reduce the overall weight of the assembly 12 (and the printing press in which it is installed). Linear or slide bearings could be used instead of the wheels 32 to control the orientation of the movable plate 30 with respect to the stationary plate 40. Finally, the system could be automated to enable a continuous and repetitive loading and adjustment of various printing press cylinder rolls 26 such that when one plate roll 26 is finished another plate roll 26 will be automatically loaded.

In addition to the aforementioned modifications, the invention is not limited to the field of printing presses. Rather, the invention is equally applicable to other related fields such as, for example, dye cutting apparatuses in which cutters must be loaded and properly registered. Accordingly, it should be understood that the apparatus and method described herein are illustrative only and are not limiting upon the scope of the invention, which is indicated by the following claims. Alternatives which would be obvious to one of ordinary skill in the art upon reading the teachings herein disclosed, are hereby within the scope of this invention.

What is claimed is:

1. An adjustable arm assembly adapted for use in a printing press, the assembly comprising:

a first stationary plate;

a first movable plate movably connected to the first stationary plate, the first movable plate comprising:

one of a catch or a capture knob assembly adapted to engage a first end of a printing press cylinder roll; and a speed control mechanism adapted to control the speed by which a printing press cylinder roll is lowered, wherein the speed control mechanism is connected to the first movable plate and is adapted to be connected to an inner surface of a printing press, and a disengagement mechanism connected to the first stationary plate, the disengagement mechanism comprising:

a rotatable block;

a wheel mechanism which is adapted to rotate the rotatable block; and a drive mechanism adapted to push the wheel mechanism so as to cause a rotation of the rotatable block.

2. The assembly according to claim 1, wherein the speed control mechanism is at least one of an air cylinder and a hydraulic cylinder.

3. The assembly according to claim 1, wherein the catch comprises a semicircular rib.

4. The assembly according to claim 3, wherein the semicircular rib is adapted to support a boss projecting from a cylindrical printing press roll.

5. The assembly according to claim 3, wherein the rib is connected to a plate, and wherein the catch further comprises a bore block adapted to engage an end of a shaft of a printing press roll.

6. The assembly according to claim 1, wherein the first movable plate is connected to the first stationary plate by a plurality of wheels.

7. The assembly according to claim 1, further comprising:

a second stationary plate; and a second movable plate movably connected to the second stationary plate by a plurality of wheels, the second movable plate comprising:

the other of the roll catch or the capture knob, wherein the other of the roll catch or the capture knob assembly is adapted to engage a second end of a printing press roll.

8. The assembly according to claim 1, wherein drive mechanism is at least one of an air cylinder and a hydraulic cylinder.

9. The assembly according to claim 8, wherein the speed control mechanism is at least one of a second air and a second hydraulic cylinder.

10. The assembly according to claim 1, further comprising:

a rod engaged with the first movable plate and adapted to be releasably engaged with a bore in the rotatable block.

11. The assembly according claim 1, wherein the disengagement mechanism is adapted to inhibit movement of the first movable plate with respect to the first stationary plate.

12. A printing press comprising:

a housing having an inner surface;

an adjustable arm assembly connected to the inner surface, the assembly comprising:

a first stationary plate;

a first movable plate movably connected to the first stationary plate, the first movable plate comprising:

at least one of a catch or a capture knob assembly adapted to engage a first end of a printing press cylinder roll;

a speed control mechanism adapted to control the speed by which the printing press cylinder roll is lowered, wherein the speed control mechanism is connected to the first movable plate and adapted to be connected to an inner surface of a printing press; and a disengagement mechanism connected to the first stationary plate, the disengagement mechanism comprising:

a rotatable block;

a wheel mechanism which is adapted to rotate the rotatable block; and a drive mechanism adapted to push the wheel mechanism so as to cause a rotation of the rotatable block; and at least one roll adapted to be contacted by the printing press cylinder roll when the printing press cylinder roll is lowered by the adjustable arm assembly.

13. The printing press according to claim 12, wherein the disengagement mechanism is adapted to inhibit movement of the first movable plate with respect to the first stationary plate.

14. The printing press according to claim 12, wherein the first movable plate is connected to the first stationary plate by a plurality of wheels.

15. The printing press according to claim 12, wherein the at least one roll is an anilox roll.

16. The printing press according to claim 12, wherein the at least one roll is an impression roll.

17. The printing press according to claim 12, wherein the at least one roll comprises an anilox roll and an impression roll.

18. The printing press according to claim 12, wherein the speed control mechanism is at least one of an air cylinder and a hydraulic cylinder.

19. The printing press according to claim 12, wherein the catch comprises a semicircular rib.

20. The printing press according to claim 19, wherein the semicircular rib is adapted to support a boss projecting from a cylindrical printing press roll.

21. The printing press according to claim 19, wherein the rib is connected to a plate, and wherein the catch further comprises a bore block adapted to engage an end of a shaft of a printing press roll.

22. The printing press according to claim 12, further comprising:

a second stationary plate; and a second movable plate movably connected to the second stationary plate by a plurality of wheels, the second movable plate comprising:

the other of the catch or the capture knob assembly, wherein the other of the catch or the capture knob assembly is adapted to engage a second end of the printing press roll.

23. The printing press according to claim 12, wherein the assembly further comprises:

a rod engaged with the first movable plate and adapted to be releasably engaged with a bore in the rotatable block.

24. The printing press according to claim 12, wherein the drive mechanism is at least one of an air cylinder and a hydraulic cylinder.

25. The printing press according to claim 24, wherein the speed control mechanism is at least one of a second air and a second hydraulic cylinder.

26. A method for loading a printing press cylinder roll in a printing press comprising the steps of:

positioning a right end of a printing press cylinder roll in a right adjustment arm assembly;

positioning a left end of the printing press cylinder roll in a left adjustment arm assembly;

actuating a plate roll capturing knob assembly to lock the printing press cylinder roll with respect to the adjustment arm assemblies;

lowering the printing press cylinder roll and the adjustment arm assemblies from an insertion position to a loaded position in which the printing press cylinder roll contacts at least one roll in the printing press;

engaging a disengagement mechanism when the printing press cylinder roll contacts the at least one roll in the printing press; and fine-tuning the orientation of the printing press cylinder roll with respect to the at least one roll in the printing press, wherein the disengagement mechanism comprises:

a threaded rod;

a rotatable block adapted to engage the threaded rod;

a wheel mechanism which is adapted to rotate the rotatable block; and a drive mechanism adapted to push the wheel mechanism so as to cause a rotation of the rotatable block.

27. The method according to claim 26, wherein the at least one roll in the printing press comprises an anilox roll.

28. The method according to claim 26, wherein the step of fine-tuning the orientation of the printing press cylinder roll with respect to the at least one roll in the printing press comprises turning the threaded rod, and wherein the threaded rod is engaged with a movable plate of one of the adjustable arm assemblies.

29. The method according to claim 26, further comprising the step of:

limiting the speed by which the printing press cylinder roll is lowered.

30. The method according to claim 29, wherein the step of limiting the speed by which the printing press cylinder roll is lowered is performed by an air or hydraulic cylinder.

31. The method according to claim 26, wherein the at least one roll in the printing press comprises an impression roll.

32. The method according to claim 31, wherein the at least one roll in the printing press further comprises an anilox roll.

33. The method according to claim 26, wherein the step of actuating a plate roll capturing knob assembly to lock the printing press cylinder roll with respect to the adjustment arm assemblies comprises:

turning a capture knob on the right adjustable arm assembly to force a plunger into the right end of the printing press cylinder roll; and forcing a left end of the printing press cylinder roll to engage a catch formed in the left adjustable arm assembly.

34. The method according to claim 26, wherein before the steps of positioning the right end of a printing press cylinder roll in the right adjustment arm assembly and positioning the left end of the printing press cylinder roll in the left adjustment arm assembly, the method further comprises the step of:

raising automatically the right and left adjustment arm assemblies to a cylinder roll loading position.

35. The method according to claim 34, wherein the step of automatically raising the right and left adjustment arm assemblies comprises:

actuating the left and right adjustable arm assemblies simultaneously.

36. The method according to claim 26, further comprising:

replacing the printing press cylinder roll with a second printing press cylinder roll.

37. The method according to claim 36, wherein the step of replacing the printing press cylinder roll is automated.

38. The method according to claim 36, further comprising the step of:

adjusting the second printing press cylinder roll with respect to the at least one roll in the printing press.

39. The method according to claim 38, wherein the step of replacing the printing press cylinder roll is automated.

40. The method according to claim 26, further comprising the step of:

establishing automatically a predetermined clearance between the printing press cylinder roll and the at least one roll of the printing press.

41. The method according to claim 40, wherein the step of establishing automatically a predetermined clearance between the printing press cylinder roll and the at least one roll of the printing press comprises the steps of:

engaging the disengagement mechanism to lock the right and left adjustment arm assemblies in the loaded position; and activating an adjustment arm raising mechanism to push the right and left adjustment arms assemblies towards the insertion position to attain the predetermined clearance.

42. The method according to claim 41, wherein the predetermined clearance is between about 0.00001" and about 0.01".

* * * * *